US009371678B2

(12) United States Patent
Keller, Jr. et al.

(10) Patent No.: US 9,371,678 B2
(45) Date of Patent: Jun. 21, 2016

(54) BARRIER OPERATOR STRAIN DETECTION

(71) Applicant: The Chamberlain Group, Inc., Elmhurst, IL (US)

(72) Inventors: Robert Roy Keller, Jr., Park Ridge, IL (US); Cory Jon Sorice, LaGrange, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 369 days.

(21) Appl. No.: 14/026,762

(22) Filed: Sep. 13, 2013

(65) Prior Publication Data

US 2015/0077219 A1 Mar. 19, 2015

(51) Int. Cl.
*G07C 9/00* (2006.01)
*E05F 15/40* (2015.01)

(52) U.S. Cl.
CPC ..... *E05F 15/40* (2015.01); *E05Y 2400/52* (2013.01)

(58) Field of Classification Search
CPC ..... E05F 15/40; E05Y 2400/52
USPC ..... 340/5.7, 5.71, 545.5, 669, 679, 686.1, 340/686.2, 68, 689
See application file for complete search history.

(56) References Cited

U.S. PATENT DOCUMENTS 4,175,431 A 11/1979 DeTournay
4,583,081 A 4/1986 Schmitz
5,193,506 A 3/1993 Ironside
5,402,105 A 3/1995 Doyle
5,402,108 A 3/1995 Tabin
5,412,297 A 5/1995 Clark
6,543,583 B1 * 4/2003 Lence Barreiro ..... B66B 5/0025 187/316
6,597,291 B2 7/2003 Tsui
6,667,591 B2 12/2003 Mullet
6,724,316 B2 4/2004 Addy
6,998,977 B2 2/2006 Gregori
7,017,302 B2 3/2006 Brookbank
7,017,312 B1 3/2006 Mueller
7,113,090 B1 9/2006 Saylor
7,113,091 B2 9/2006 Script
7,260,917 B2 8/2007 Brookbank
7,263,802 B2 9/2007 Fitzgibbon
7,493,726 B2 2/2009 Fitzgibbon
7,554,445 B2 6/2009 Script
7,592,767 B2 9/2009 Rodriguez
7,679,301 B2 3/2010 Gregori (Continued)

OTHER PUBLICATIONS http://www.liftmaster.com/lmcv2/pages/productmodeldetail.aspx?modelId=9570; showing product available as soon as Aug. 25, 2011.

(Continued)

*Primary Examiner* — Edwin Holloway, III
(74) *Attorney, Agent, or Firm* — Fitch, Even, Tabin & Flannery LLP

(57) ABSTRACT

A barrier sensor device and associated control device monitor operation of a barrier operator system. The barrier sensor device monitors operation of barrier operators for undesirable amounts of strain without barrier operator force as an input. The barrier sensor device instead detects both motion and tilt of a barrier. By monitoring these two aspects of barrier operation, the barrier sensor device compiles data that can be analyzed by the control device and compared to un-strained or previously compiled barrier operator data to determine whether the barrier operator system is under strain and requires service.

42 Claims, 10 Drawing Sheets

(56) References Cited

U.S. PATENT DOCUMENTS

| | | | | |
|---|---|---|---|---|
| 7,689,293 | B2 | 3/2010 | Weik, III et al. | |
| 7,729,807 | B2 | 6/2010 | Guillemot | |
| 8,179,275 | B2 | 5/2012 | Jankovsky | |
| 8,384,557 | B2 | 2/2013 | Gunton | |
| 2003/0071739 | A1* | 4/2003 | Addy | B08B 13/08 340/686.1 |
| 2005/0022451 | A1* | 2/2005 | Fitzgibbon | E05F 15/668 49/31 |
| 2005/0253710 | A1* | 11/2005 | Eskildsen | G08B 13/08 340/545.5 |
| 2006/0220834 | A1* | 10/2006 | Maeng | G08B 21/24 340/539.1 |
| 2007/0000622 | A1* | 1/2007 | Reed | E05F 15/684 160/188 |
| 2010/0019916 | A1* | 1/2010 | Jankovsky | E05D 13/1269 340/679 |
| 2010/0032332 | A1* | 2/2010 | Davis | G08B 13/1436 206/459.1 |
| 2013/0277437 | A1* | 10/2013 | Longyear | G06M 1/00 235/91 R |
| 2013/0290191 | A1 | 10/2013 | Dischamp | |

OTHER PUBLICATIONS http://www.liftmaster.com/lmcv2/pages/productmodeldetail.aspx?modelid_9571; showing product available as soon as Mar. 17, 2011.

* cited by examiner

300

400

BARRIER OPERATOR STRAIN DETECTION

FIELD

The present application relates generally to barrier operators and more specifically to adding features to pre-installed barrier operators.

BACKGROUND

Barrier operators of various kinds have been known and used for many years. Examples of such barrier operators include gate operators, rolling shutter operators, garage door operators, and the like. In one example, garage door operators are mounted within a garage to automate the process of opening and closing a garage door. Such garage door operators are designed to last for many years. In its simplest form, a garage door operator includes a motor connected to move a barrier between an open position and a closed position and control circuitry configured to control the motor. Such garage door operators can last and reliably operate a garage door for many years with basic maintenance.

More recently, however, barrier operators have begun evolving to include additional features beyond the simple task of opening and closing the barrier. For example, barrier operators can monitor the force during operation thereof. Force is an accurate measure of a movable barrier system's smooth operation, but force is not available as part of a retrofit solution. Specifically, a retrofit solution likely cannot know the force of older or competitive barrier operators because the retrofit would not have access to the barrier operator's firmware.

When the counter balance mechanism or guiderails of the movable barrier system become misaligned or wear, the barrier operator has to increase its force applied to ensure a consistent and smooth open or close action. Failures to maintain a smooth door operation can result in wear on the operator when opening, possible overrun speed when going down, and eventually motor burn out.

SUMMARY

Generally speaking, and pursuant to these various embodiments, a barrier sensor device and associated control device is designed to monitor operation of barrier operator systems. The barrier sensor device is configured to monitor operation of barrier operators, such as previously-installed, older generation, or operators where force cannot be easily measured, for undesirable amounts of strain without barrier operator force as an input. Instead, the barrier sensor device is configured to detect both motion and tilt of a barrier. By monitoring these two aspects of barrier operation, the barrier sensor device compiles data that can be analyzed by the control device and compared to un-strained barrier operator data to determine whether the barrier operator system requires service.

BRIEF DESCRIPTION OF THE DRAWINGS

The above needs are at least partially met through provision of the barrier operator feature enhancement described in the following detailed description, particularly, when studied in conjunction with the drawings wherein.

Figure 1:
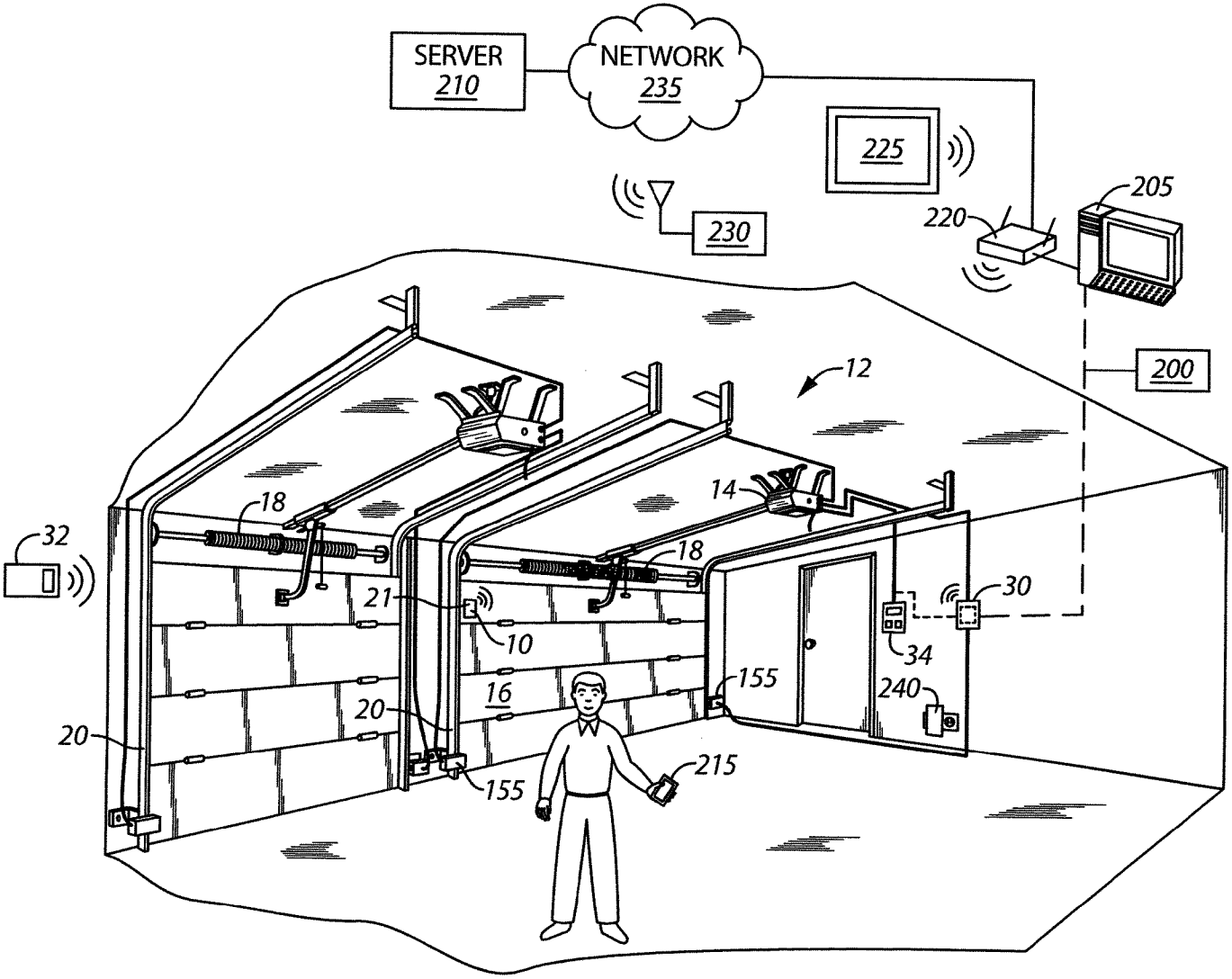
FIG. 1 is a perspective view of an example environment in which a barrier operator system sensor device may be applied as configured in accordance with various embodiments of the invention.

Skilled artisans will appreciate the elements and the figures are illustrated for simplicity and clarity and have not necessarily been drawn to scale. For example, the dimensions and/or relative positioning of some of the elements in the figures may be exaggerated relative to other elements to help improve understanding of various embodiments. Also, common but well understood elements that are useful or necessary in a commercially feasible embodiment are often not depicted to facilitate a less obstructive view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions and a person skilled in the technical field as set forth above, except where different specific meanings have otherwise been set forth herein.

DETAILED DESCRIPTION

A barrier sensor device 10 as described herein advantageously provides monitoring of a movable barrier system 12, which can include a barrier operator 14, a movable barrier 16, a counter-balance mechanism 18, and guidance structure 20, such as guiderails. In one approach, the barrier sensor device 10 is secured to the barrier 16 and includes one or more sensing devices 21 that are configured to obtain position and movement data regarding operation of the movable barrier system 12 without communication with the barrier operator 14.

More specifically, the barrier sensor device 10 monitors and reports the position of the barrier 16, such as with a tilt sensor 22 or the like, to determine whether the barrier 16 is in an open or a closed position. Next, the barrier sensor 10 detects and reports motion of the barrier 16, such as with an accelerometer or vibration sensor 24 or the like. Combined together, these functionalities allow the barrier sensor device 10 to determine the amount of time it takes for the barrier 16 to travel from the open position to the closed position or from the closed position to the open position. The combination of two different sensing components that provide complimentary information allows the barrier sensor device 10 to know the status, whether open, closed, or moving, of the barrier 16 at all times. The barrier sensor device 10 can be a transmit-only device that transmits position and movement information in response to any change of the position of the barrier 16. In an alternative approach, the barrier sensor device 10 can be a bidirectional communication device allowing other devices to request information about the position and movement data of the barrier 16.

In one example, the data can be utilized by a control device 30 in communication with the barrier sensing device 10 to determine whether the barrier operator 14 is under strain as a result of mechanical problems of the barrier operator 14, wear of the counter-balance mechanism 18, wear or misalignment of the barrier guidance structure 20, or the like.

Referring now to the drawings and, in particular, to FIG. 1, an example environment in which the barrier sensor device 10 may operate will now be presented. The barrier operator 14, which can be pre-installed, is configured to move the barrier 16 between open and closed positions along the guide rails 20. In the illustrated example, the barrier operator 14 is a garage door opener configured to open and close a garage door for a typical garage, although the subject matter described herein can be applied to a variety of other barrier operator settings. The barrier operator 14 can be activated to open or close the barrier 16 using a remote control device 32 or a wired wall control device 34. The remote control device 32 communicates directly with the barrier operator 14 using a radio frequency based, wireless communication that is received and analyzed by the barrier operator 16 to determine what action it should take in response to receipt of the signal from the remote control device 32. Similarly, the wall control device 34 includes buttons that when pressed effect sending a signal over the wire to the barrier operator 14 to effect the opening or closing of the barrier 16 or performance of another action.

The barrier sensor device 10 is configured to be secured to the barrier 16 by any suitable method, including, for example, fasteners (such as screws, etc.), adhesive, or the like. So configured, the barrier sensor device 10 moves with the barrier 16 and, in the example of FIG. 1, the tilt sensor 22 can sense whether the barrier 16 is in a horizontal orientation in the open position along the roof of the garage or in a vertical orientation in the closed position. Moreover, the accelerometer sensor 24 can sense whether the barrier 16 is in motion via the movement or vibration thereof.

Additional details of one example barrier sensor device 10 will now be described with reference to FIGS. 2-4. The barrier sensor device 10 includes a housing 100 configured to be secured to the barrier 16, such as with fasteners through openings in a back surface thereof. The housing 100 includes front and rear portions 102, 104 that removably secure together to enclose an electronic assembly 106 of the barrier sensor device 10 therein. In the illustrated form, the rear housing portion 104 includes a depressible button or tab 107 on a side thereof that, when depressed, causes a latching mechanism to disengage from the front housing portion 102. Other securing mechanisms can also be utilized, such as fasteners, snap-fit, tongue-and-groove, and the like.

Figure 5:
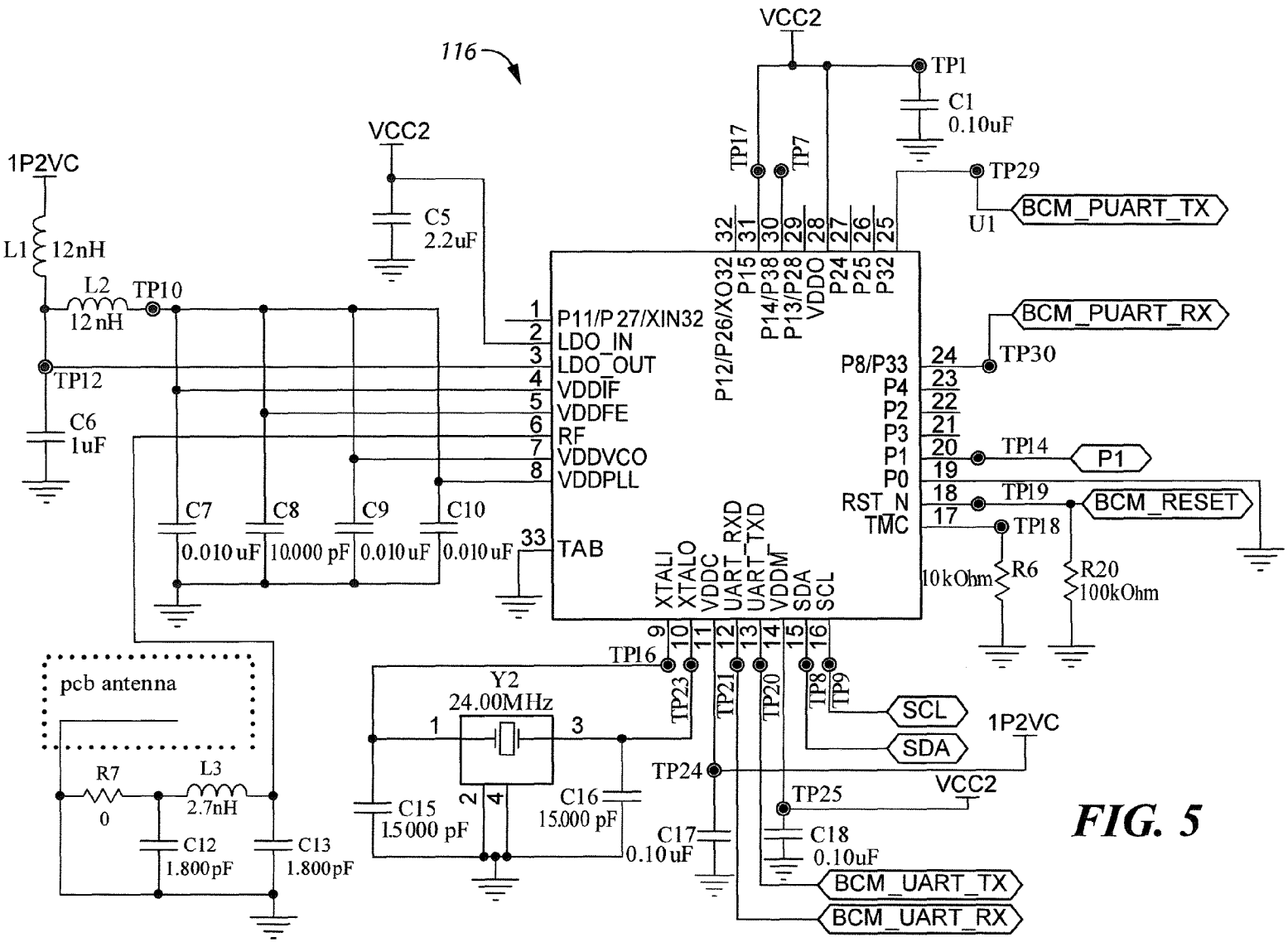
FIG. 5 is a circuit diagram showing an example circuit board for the barrier sensor device as configured in accordance with various embodiments of the invention.
Figure 6:
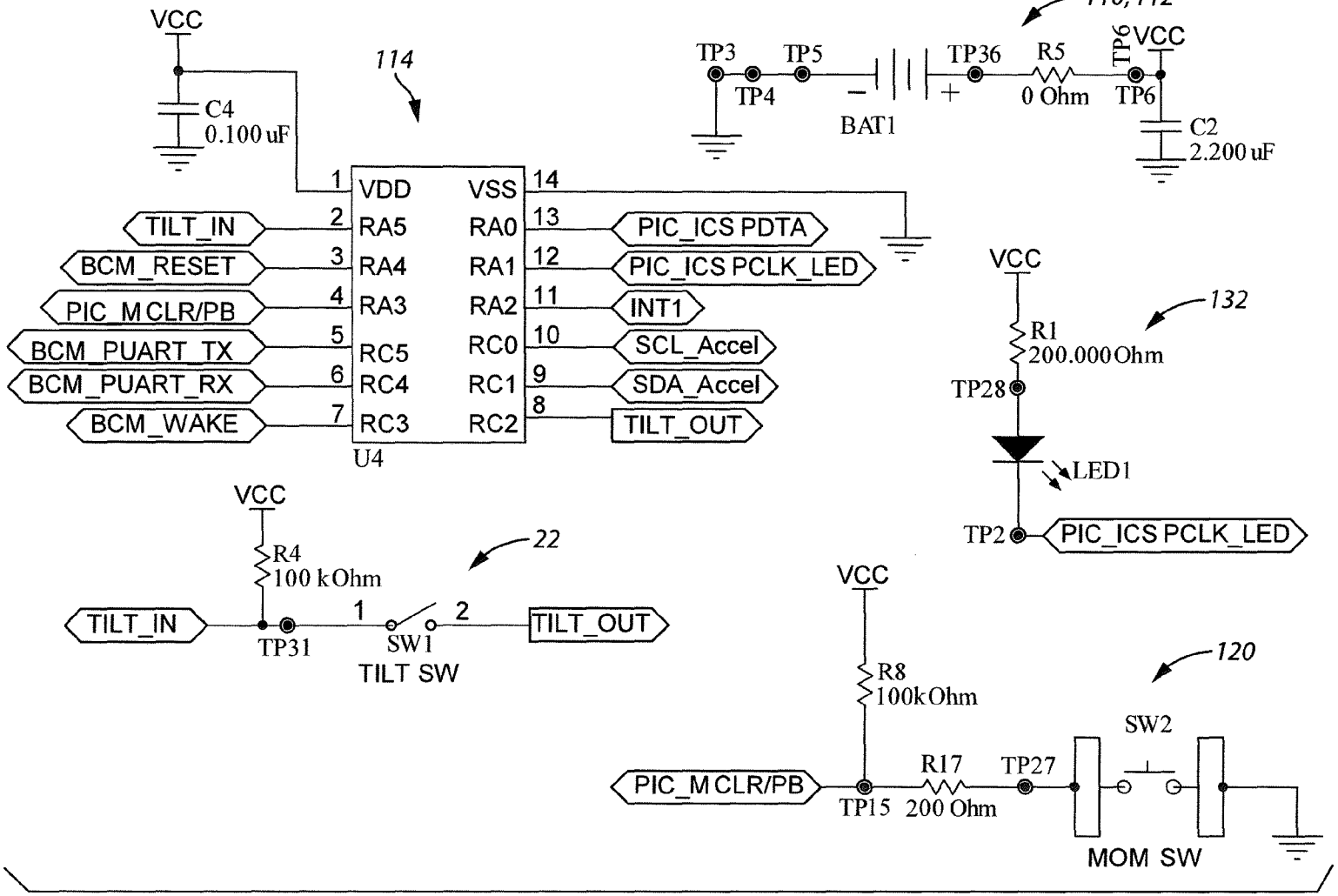
FIG. 6 is a plurality of circuit diagrams showing example circuits for devices operably coupled to the circuit board of FIG. 5 as configured in accordance with various embodiments of the invention.

By one approach, the electronic assembly 106 includes a circuit board 108 having the tilt sensor 20 and accelerometer sensor 22 mounted thereto. The circuit board 108 is disposed within the housing 100 and secured thereto, such as by adhesive, fasteners, or the like. The circuit board 108 includes a power source bay or compartment 110 mounted thereto and sized to frictionally receive a coin cell battery 112 therein to provide power to the electronic assembly 106. Other power sources, both rechargeable and replaceable, can also be utilized, and can be coupled to the circuit board using wiring or the like. A circuit diagram of one exemplary circuit board is shown as element 108 in FIG. 5. A circuit diagram of one exemplary power source and electrical coupling is shown as elements 110, 112 in FIG. 6.

The tilt sensor 22 may comprise a microelectromechanical (MEMS) switch, an optical sensor, or other physical switch that is mounted to detect the barrier's 16 orientation. For example, the tilt sensor 22 is mounted on the barrier 16 to determine the barrier's 16 vertical or horizontal orientation and based on that information, a determination can be made as to whether the door is open, i.e., the barrier is horizontally disposed, or closed, i.e., the barrier is vertically disposed. A circuit diagram of one exemplary tilt sensor is shown as element 22 in FIG. 6. Alternatively, a variety of other sensors may be used such as a limit switch, an accelerometer, a gravity sensor, or combinations thereof. Limit switches can be magnetic or physical switches placed along a track or other path of travel for the switches to detect the location of the barrier 16.

The accelerometer 24 may be piezo electric based or may be a MEMS switch, as known in the art. A circuit diagram of one exemplary accelerometer is shown as element 24 in FIG. 7.

Figure 2:
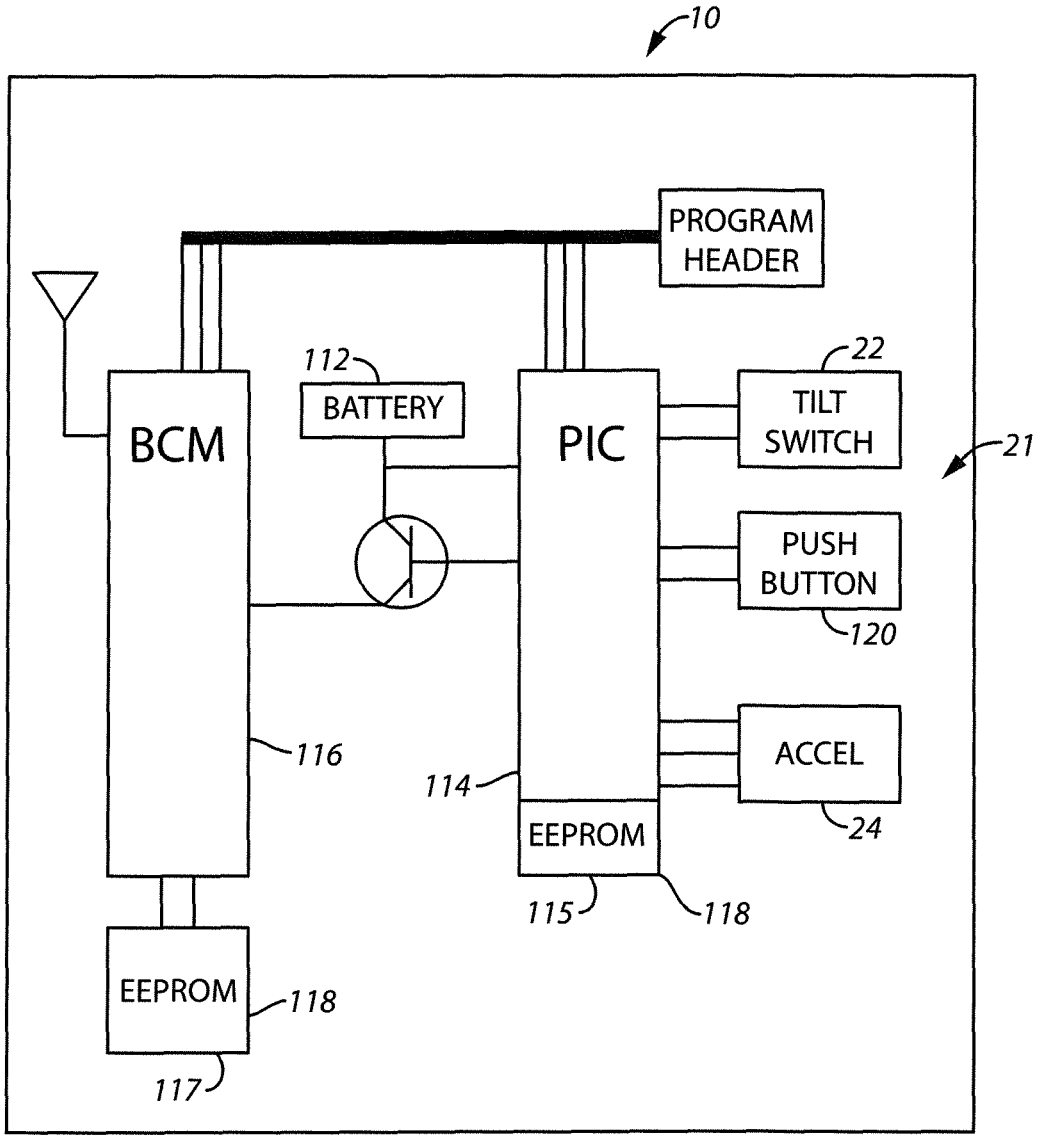
FIG. 2 is a block diagram of an example barrier sensor device as configured in accordance with various embodiments of the invention.
Figure 7:
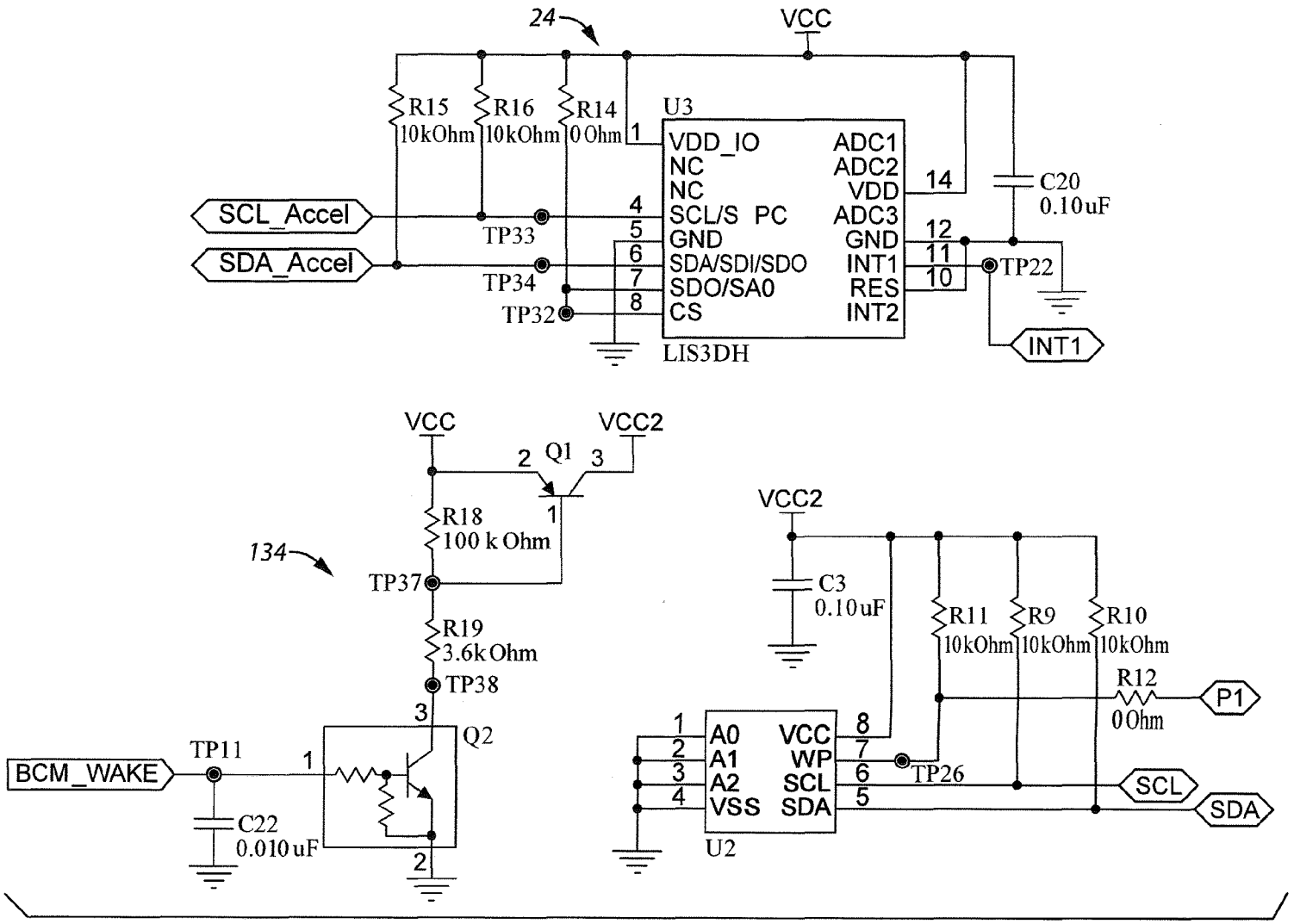
FIG. 7 is a plurality of circuit diagrams showing example circuits for devices operably coupled to the circuit board of FIG. 5 as configured in accordance with various embodiments of the invention.

In the illustrated example, the barrier sensor device 10 is remote from the control device 30 and, as such, the barrier sensor device 10 includes a processing device 114, such as a PIC16LF1824, illustrated as PIC in FIG. 2, and a communication interface 116. The processing device 114 and communication interface 116 are preferably mounted on the circuit board 108. The processing device 114 is configured to control operation of the sensing devices 21, monitor the power of the electronic assembly 106, and control communication with the control device 30 via a wireless radio communication through the communication interface 116. The wireless communication can follow any protocol including single frequency, spread spectrum, Wi-Fi, BLUETOOTH, MyQ, and the like. By one approach, the communication interface 116 is a communication processor that is configured to implement BLUETOOTH radio transmission and reception, such as processors available from Broadcom and illustrated as BCM in FIG. 2. The electronic assembly 106 can further include one or more memories 118, such as EEPROM, sized and configured to store operational details and data collected by the sensing devices 21. In one example, the processing device 114 can have an associated memory 115 and the communication processor 116 can have an associated memory 117, one example circuit of which is shown in FIG. 7. A circuit diagram of one exemplary processing device is shown as element 114 in FIG. 6. A circuit diagram of one exemplary communication processor is shown as element 116 in FIG. 5.

The electronic assembly can further include a switch device 120 that may be mounted to the circuit board 108. The switch device 120 can take any suitable form, such as a push-button switch device as shown, a slide switch, a rotary switch, or the like. The switch device 120 can be utilized for user interaction and input into the operation of the barrier sensing device 10. The switch device 120 can be configured to perform various functions for the barrier sensing device 10. One such function is causing the barrier sensor device to initiate a learn sequence, which will be discussed in greater detail below. Another function is testing operation of the barrier sensor device 10, such as testing whether the power source has sufficient capacity for continued operation, testing communication with the control device 30, manually causing the barrier sensor device 10 to report barrier position, or the like. A circuit diagram of one switch device is shown as element 120 in FIG. 6.

Figure 3:
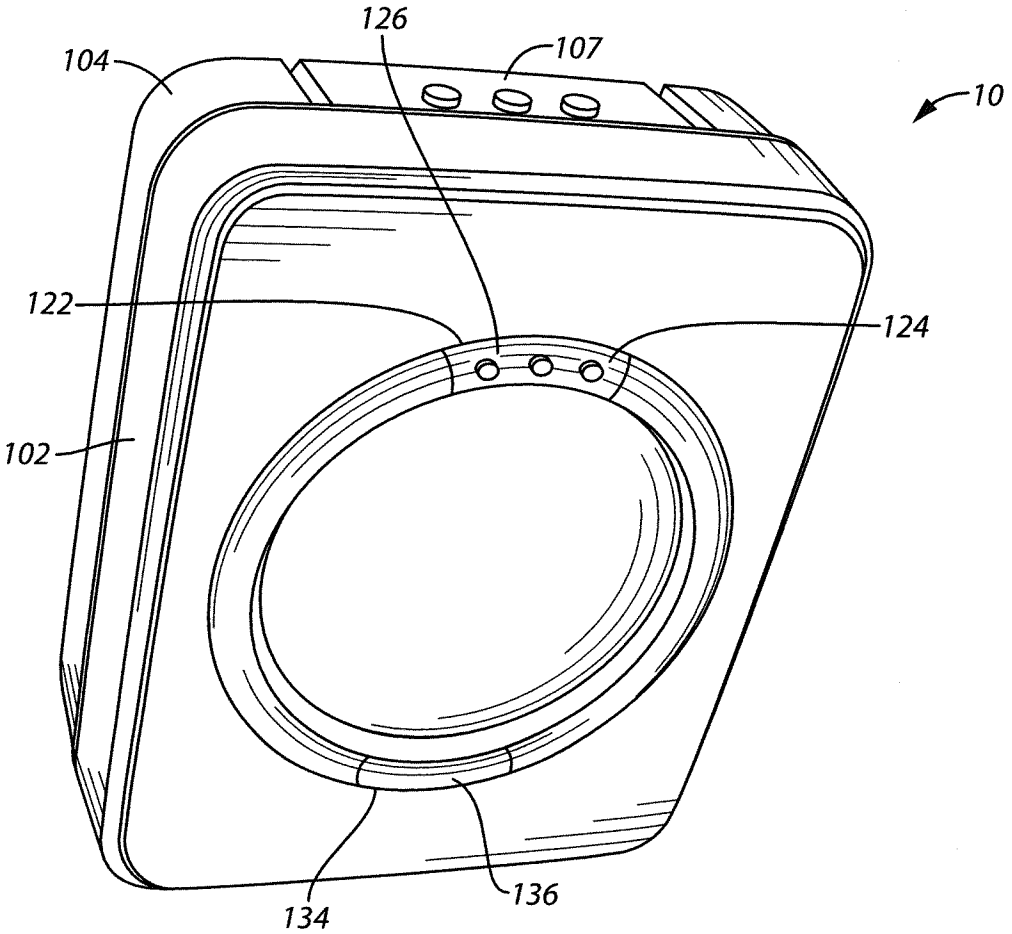
FIG. 3 is a perspective view of an example barrier sensor device as configured in accordance with various embodiments of the invention.
Figure 4:
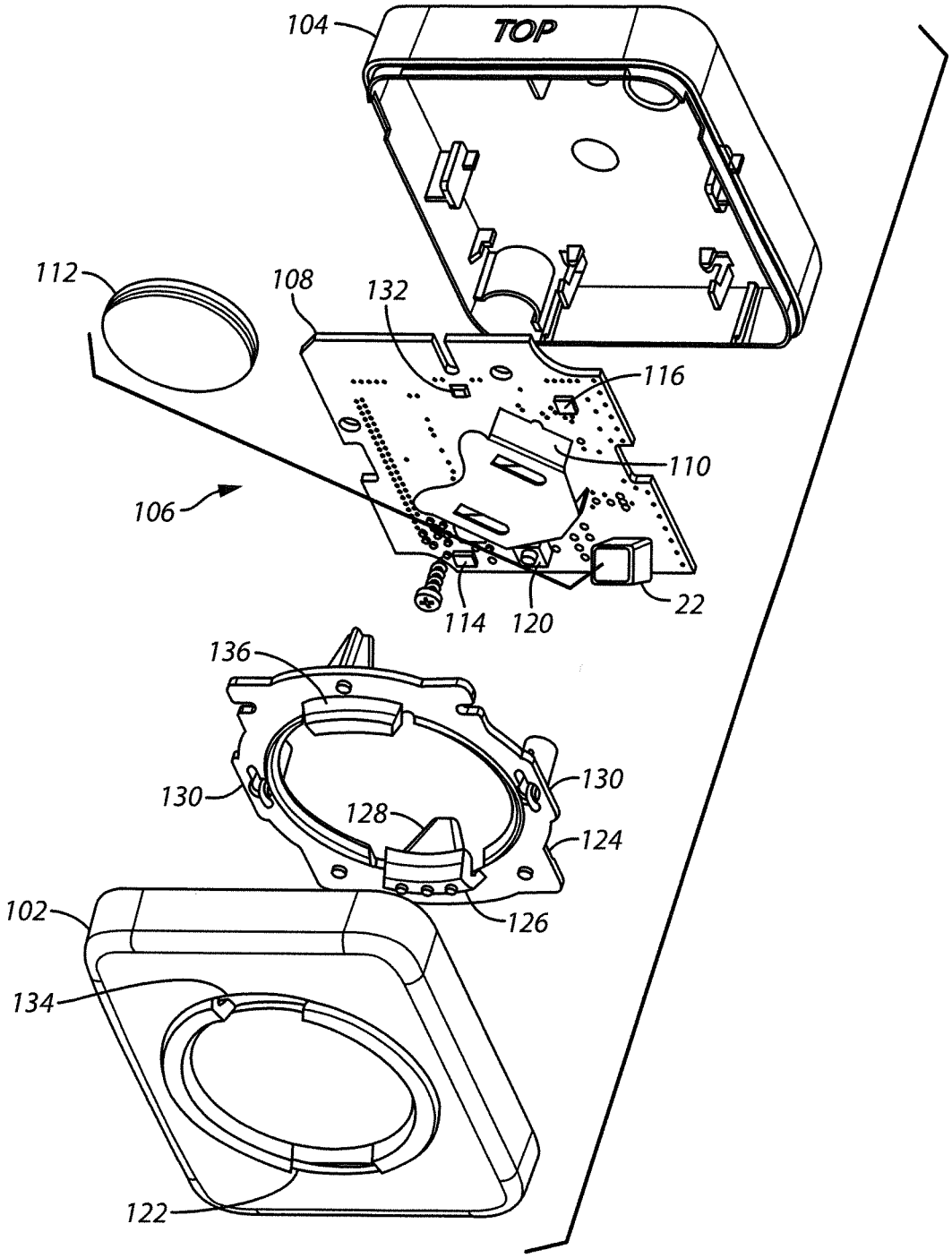
FIG. 4 is a perspective exploded view of the barrier sensor device showing a housing and circuit board configured to be disposed within the housing in accordance with various embodiments of the invention.

As shown in FIGS. 3 and 4, the front housing portion 102 can be configured so that a user can easily actuate the switch device 120 despite the switch device 120 being enclosed within the housing 100. More specifically, the front housing portion 102 can include an opening 122 therein aligned with the switch device 120 mounted to the circuit board 108. A resilient button member 124 can be mounted to the front housing portion 102 that includes an outwardly projecting button portion 126 configured to project through the opening 122 in the front housing portion 102 and an inwardly projecting actuating portion 128 configured to project into the housing 100 so that depressing the button portion 126 causes the actuating portion 128 to engage and actuate the switch device 120. The button member 124 can be secured to the front housing portion spaced from the button portion 126 thereof, so that the button portion 126 can easily flex inwardly upon depression thereof. In the illustrated form of FIG. 3, the button member 124 is configured to secure in a middle portion 130 thereof spaced from the end where the button portion 126 and actuating portion 128 are located. The button member 124 can secure to the front housing portion 102 can any suitable mechanism, including snap-fit structure, adhesive, fasteners, or the like.

Additionally, the electronic assembly can include a light source 132, such as a surface mount LED mounted to the circuit board 108 as shown, that is configured to provide a visual indication of operation of the barrier sensor device 10. For example, the processing device 114 can cause the LED 132 to energize upon depression of the switch device 120, during movement of the barrier 16, during transmission or reception of communications with the control device 30, or the like. As shown, in FIG. 3, the front housing portion 102 can also include a light opening 134 therein aligned with the LED 132. Advantageously, the button member 124 can include a translucent or transparent portion 136 configured to align with and at least partially project into the light opening 134. As such, a user can see the light when energized, but the housing 102 does not have a large opening therein, which can undesirably allow dust or other foreign particles into the housing 100.

So configured, the processing device 114 can be responsible for one or more of the following functions: monitoring the tilt sensor 22, monitoring and controlling the accelerometer sensor 24, monitoring the switch device 120, illuminating the LED 132, controlling a power circuit that provides power to the communication processor 116 and its associated memory 117, such as the circuit shown as element 134; storing rolling code data, storing settings for the tilt sensor 22 and/or the accelerometer sensor 24; storing cycle count; storing paired Controller BLUETOOTH Device Addresses; providing battery brown out protection for the barrier sensor device 10; providing a timer to communicate the barrier status and/or the position and movement data to the communication processor 116, which can be any desired interval, such as hourly, twice a day, daily, twice a week, etc.; and providing communication to the communication processor 116 for transmission to the control device 30. One example language is universal asynchronous receiver/transmitter (UART) that translates data between parallel and serial forms. As such, the communication processor 116 can be responsible for connectivity with the control device 30, storing pairing and encryption data for any paired devices in its associated memory 117, and providing UART communication to the processing device 114.

The processing device 114 can be configured to manipulate and store one or more parameters for the tilt sensor 22 and the accelerometer sensor 24. Advantageously, the parameters can be configurable by a signal from the control device 30, which can be utilized to avoid excessive battery drain and false notifications of barrier movement. Employing the radio link between the control device 30 and the barrier sensor device 10 allows the monitoring algorithm to be continuously adjusted and fine-tuned without physical adjustments to the sensors, and allows for software updates after sale. More specifically, the parameters can include one or more of: a tilt switch debounce setting configured to account for, and preferably eliminate, contact bounce or chatter; wake up intervals for presence reporting; X, Y, and/or Z axis acceleration interrupt change values; and a battery life warning setting.

The processing device memory 115 can be configured to store one or more of: the address of the control device 30, a rolling code to communicate with the control device 30; a threshold of the accelerometer sensor 24, a monitor period of the accelerometer sensor 24, a minimum count of interrupts per monitor period to correspond to movement of the barrier 16, a maximum count of interrupts per monitor period to correspond to non-movement of the barrier 16, a debounce time of the tilt sensor 22, a cycle count of barrier close events via the tilt sensor 22, a cycle count of barrier open events via the tilt sensor 22, a BLUETOOTH advertising channel map, a transmit power, and one or more setup registers for the accelerometer sensor 24.

The processing device 114 can operate software that is configured to monitor the other elements of the electronic assembly 106. For example, the software can monitor the tilt sensor 22 and the timer via polling. By another example, the software can monitor the accelerometer sensor 24 and the switch device 120 via a hardware interrupt on state change.

The barrier sensor device 10 can be configured to minimize power consumption and, therefore, maximize the life of the battery 112. For example, the processing device 114 can be configured to remain in its lowest power state unless higher power states are required for event processing. Likewise, the communication processor 116 can be powered off until and unless a connection with the control device 30 or other peripheral device is required.

Control Device

As set forth above, the barrier sensor device 10 is in communication with the control device 30, so that the control device 30 can analyze the position and movement data to track the operation and status of the movable barrier system 12. It will be understood that the control device 30 can be mounted at any desirable location to communicate with the barrier sensor device 10. For example, the control device 30 can be disposed within a common housing of and/or integral with the barrier sensor device 10 and attached to the barrier 16. Alternatively, and as shown in FIG. 1, the control device 30 can be a retro-fit device configured to be mounted or located remote from the barrier sensor device 10, such as within the garage or structure attached to the garage. By yet another approach, the control device 30 can be a cloud-based device. Those skilled in the art will recognize and understand that the control device 30, as described herein, may be comprised of a plurality of physically distinct elements, which can utilize a shared, programmable platform.

The control device 30 is configured to receive communications from and/or send communications to the barrier sensor device 10. These communications can be performed by a number of different physical layer structures. In one example, the communication can be carried via a wired or bus connection or via a wireless radio communication. The wireless communication can follow any protocol including single frequency, spread spectrum, Wi-Fi, BLUETOOTH, and the like. In one example, the control device 30 is configured to establish a BLUETOOTH connection with the communication processor 116.

Additionally, the control device 30 can be configured to identify and/or ignore data collected during error operations, such as when sensor eyes are tripped during an operation. To identify the error operations, the control device 30 can be configured to receive communications from an obstacle detector 155 or can compare the error operation time to a previously measured time for an operation that had been included in the data set.

For example and with reference to FIG. 1, the control device 30 may further be configured to communicate with a computing device 200, a home computer 205, a server computing device 210, a mobile computing device 215, a gateway device 220 configured to enable communications with one or more of a home computer 205, server computing device 210, a mobile computing device 225, or a mobile computing device 230 over a network 235, and combinations thereof. Alternatively, the control device 30 can have a gateway device incorporated therein. Communications with any of these devices can be made using wired or wireless protocols as are known in the art. Communications with such computing devices can facilitate all manner of network communications such as communications with applications on smart phones and the like or facility monitoring systems as may be available or controlled by networked computing devices.

In yet another approach, the control device is configured to receive communications from at least one peripheral device including a network adapter 240 to effect a connection to the Internet. As illustrated in FIG. 1, the network adapter 240 is a separate device plugged into the wall that can communicate with the control device 30 using any available communication method. The network adapter 240 then has a separate connection to a network that facilitates a communication to the Internet. This communication or connection can be accomplished in a variety of ways as recognized by those skilled in the art. For example, the network adapter 240 may have a wireless connection to a cellular standard to facilitate the connection to the Internet. By another approach, the network adaptor 240 can incorporate a power line communication protocol whereby communications are transmitted over local power lines between devices connected to the power lines. In still another approach, the network adaptor 240 can create a network connection via an Ethernet wire line connection to a network device. Another example network adapter 240 connection approach is a Wi-Fi connection such as with the wireless device 220. The network adaptor 240, in various alternative approaches, can plug into the control device 30 to provide such communication abilities or be built into the control device 30. For instance, in this example, the control device 30 can communicate using a wireless communication standard such as Wi-Fi to exchange network communications with the network device 220. The data analysis discussed herein as being performed by the control device 30, will be understood to equally apply to being performed by one or more devices in communication therewith, such as a server device at the direction of web-based or application-based controls.

So configured, example operation of the barrier sensor device 10 can include one or more of: the processing device 114 monitoring inputs from the tilt sensor 22, the accelerometer sensor 24, and the switch device 120; assessing whether a tilt, door motion, or button event has occurred; obtaining and transferring the relevant sensor information to the communication processor 116; and instructing the communication processor 116 to establish a connection with the control device 30. Once the connection is established, example operation of the control device 30 can include one or more of: the control device 30 reading data collected by the tilt and accelerometer sensors 22, 24; analyzing a current strain state of the movable barrier system 12; and writing or altering sensor parameters. Then, the example operation of the barrier sensor device 10 can further include one or more of: the communication processor 116 sending any messages from the control device 30 to the processing device 114; the processing device 114 monitoring for additional events for a given time period, such as 10 seconds, 30 seconds, 1 minute, 5 minutes, or the like; the processing device causing the connection to the control device 30 to be re-established if another event occurs; and the processing device 114 powering off the communication processor 116 if another event is not detected.

Example Sensor Operation

Figure 9:
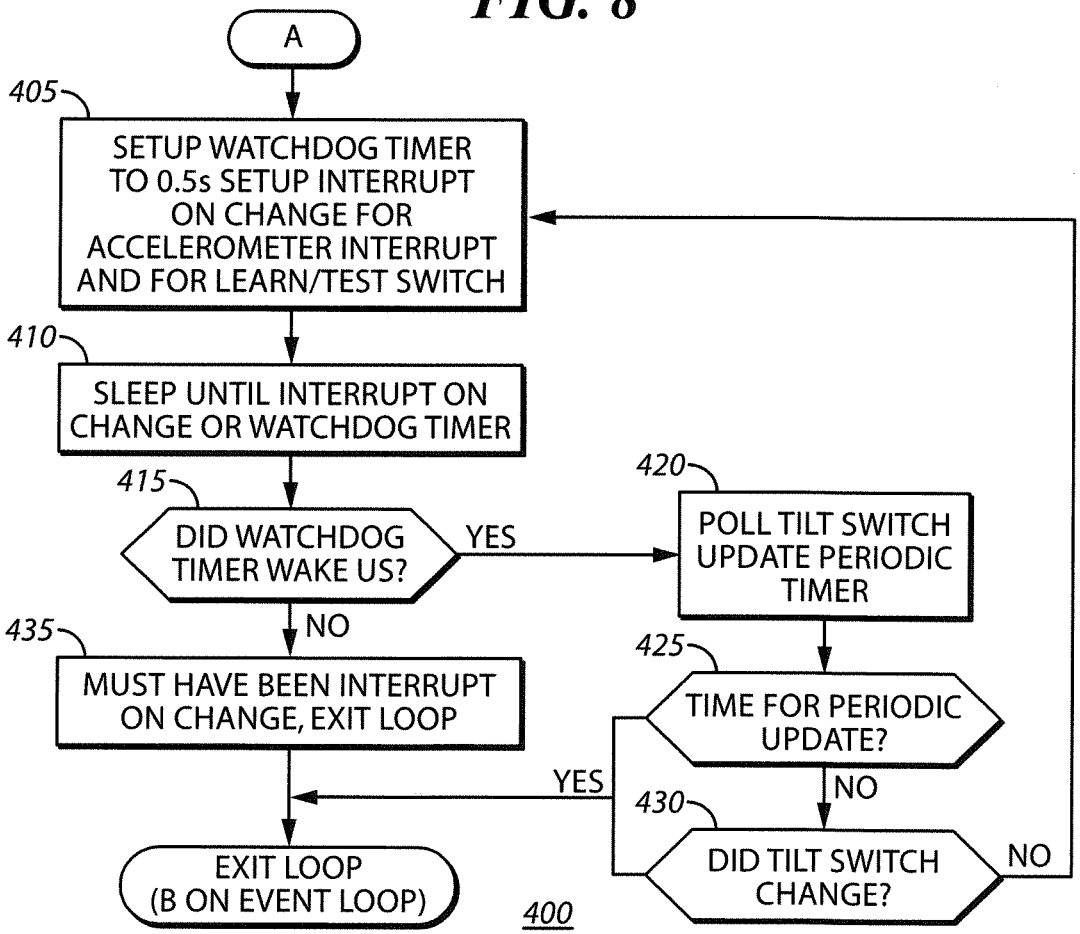
FIG. 9 is a flow diagram of an example method of operation for a polling loop for a barrier sensor device as configured in accordance with various embodiments of the invention.
Figure 10A:
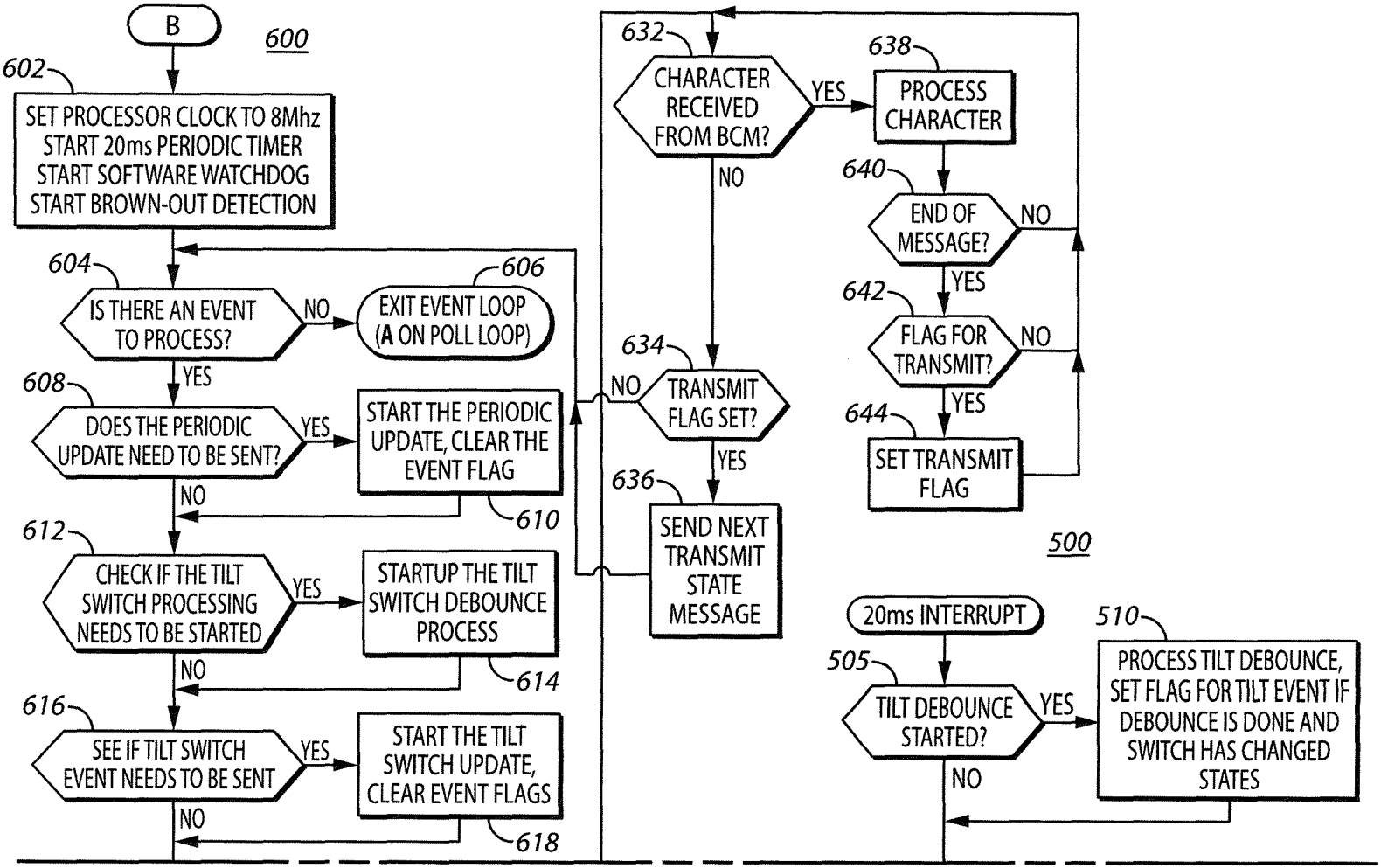
FIG. 10A includes first portions of a flow diagram of an example method of operation for an event loop for a barrier sensor device and a flow diagram of an example method of operation for an interrupt loop for a barrier sensor device as configured in accordance with various embodiments of the invention.
Figure 10B:
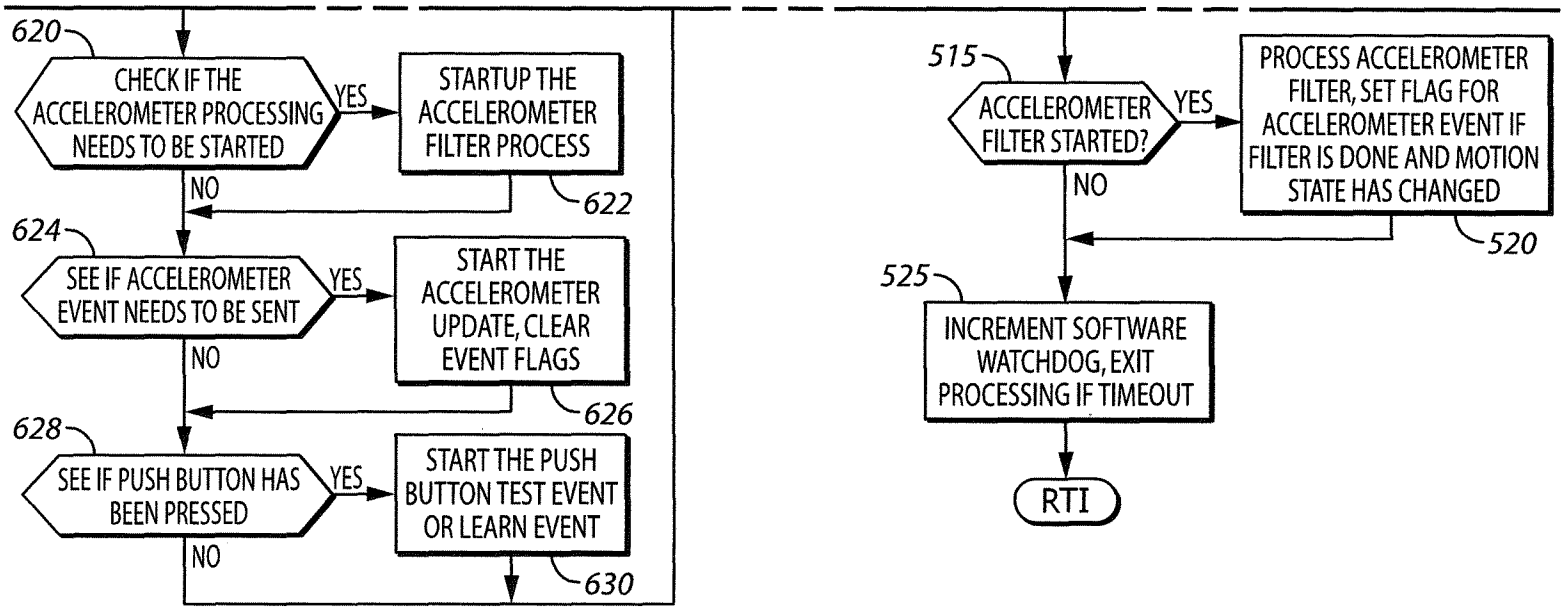
FIG. 10B includes second portions of the flow diagram of the example method of operation for the event loop and the flow diagram of the example method of operation for the interrupt loop of FIG. 10A.

One specific operation flow will now be described with reference to FIGS. 9-10. When the polling loop A 400 is exited, the event loop B 500 is entered. Event loop B 500 is event driven, so once all events have been processed, event loop B 500 is exited and the polling loop A 400 is re-entered.

At step 405 of loop A, the watchdog timer is set to 0.5 seconds, and an interrupt is set on a change for the accelerometer sensor and for the switch device. The process then sleeps 410 until a change is detected or the watchdog timer times out. If the watchdog timer did not wake the processing device, it must correspond 420 to an interrupt or event change and the process goes to loop B or the interrupt loop, shown in FIG. 10. It is then determined if the watchdog timer woke 415 the processing device 114. If the watchdog timer woke the processing device, the processing device polls 420 the tilt sensor and updates the periodic timer. The processing device then determines 425 whether it is time for a periodic update. If yes, the process goes to loop B. If no, the processing device determines 430 whether the state of the tilt sensor changed. If yes, the process goes to loop B. If no, the process loops back to the setup step 405. If the watchdog timer did not wake the processing device 114, it is determined 435 that it must have been an interrupt on change and the process is sent to loop B.

With the interrupt loop 500, the processing device determines 505 whether the tilt debounce has started. If yes, the processing device processes 510 the tilt debounce and sets a flag for the tilt event if both the debounce is done and the tilt sensor has changed states. After that, or if the tilt debounce has not started, the processing device determines 515 whether the accelerometer filter has started. If yes, the processing device processes 520 the accelerometer filter, sets a flag for the accelerometer event if the filter is done and the motion state has changed. After that, or if the accelerometer filter has not started, the processing device increments 525 the software watchdog and exits processing if timed out.

With loop B 600, in step 602 the processor clock is set to 8 Mhz, a 20 ms Periodic Timer is set, the software watchdog is started, and the brown-out detection is started. The processing device first determines 604 whether there is an event to process. If no, the process is sent 606 back to loop A. If yes, the processing device determines 608 whether the periodic update event needs to be sent. If yes, the periodic update is started and the event flag is cleared 610. After that, or in response to the event not needing to be sent, the processing device checks 612 if the tilt sensor processing needs to be started. If yes, the tilt sensor debounce process is started 614. After that, or in response to the tilt sensor processing not needing to start, the processing device checks 616 if a tilt switch event needs to be sent. If yes, the tilt switch is updated and the event flags are cleared 618. After that, or in response to the tilt switch event not needing to be sent, the processing device checks 620 if the accelerometer processing needs to be started. If yes, the accelerometer filter process is started 622. After that, or if the accelerometer processing does not need to be started, the processing device determines 624 whether an accelerometer event needs to be sent. If yes, the processing device starts the accelerometer update and clears event flags 626. After that, or if an accelerometer event does not need to be sent, the processing device determines 628 if the switch device has been actuated. If yes, the processing device starts 630 the switch test event or the learn event. After that, or if the switch device has not been actuated, the processing device determines 632 whether a character has been received from the communication processor. If no, the processing device determines 634 if the processing flag is set and, if it is, the processing device sends 636 the next transmit state message. After that, or if the processing flag is not set, the process is sent back to start up at loop B. If a character is received from the communication processor, the processing device processes 638 the character. If the processing device does not reach 640 the end of the message, the process is sent back to start up at loop B. If the end of the message is processed, the processing device determines 642 whether the message should be flagged for transmission. If no, the process is sent back to start up at loop B. If yes, the processing device sets 644 the transmit flag and the process is sent back to start up at loop B.

As discussed above, the control device 30 can be configured to communicate with the mobile communication device 215. This relationship can be utilized by a user to control operation of the control device 30 and the barrier sensor device 10. More specifically, after analysis of the position and movement data, if the control device 30 determines that there is an issue or potential issue with the barrier operator system, the control device can send a service signal to the mobile device 215. The control device 30 can also be configured to send a "normal" operation signal to the mobile device 215 to update a user of the barrier system that everything is operating normally. In one example, the signals sent to the mobile device 215 can include: "Normal Operation", "Strained Garage Door Operation: Recommend Service Review" and "Garage Door/Operator Requires Service Attention As Soon As Possible". Additionally, the user can instruct the control device 30 with the mobile device 215 to update parameters and configure the barrier sensor device 10.

Data Analysis Examples

Figure 8:
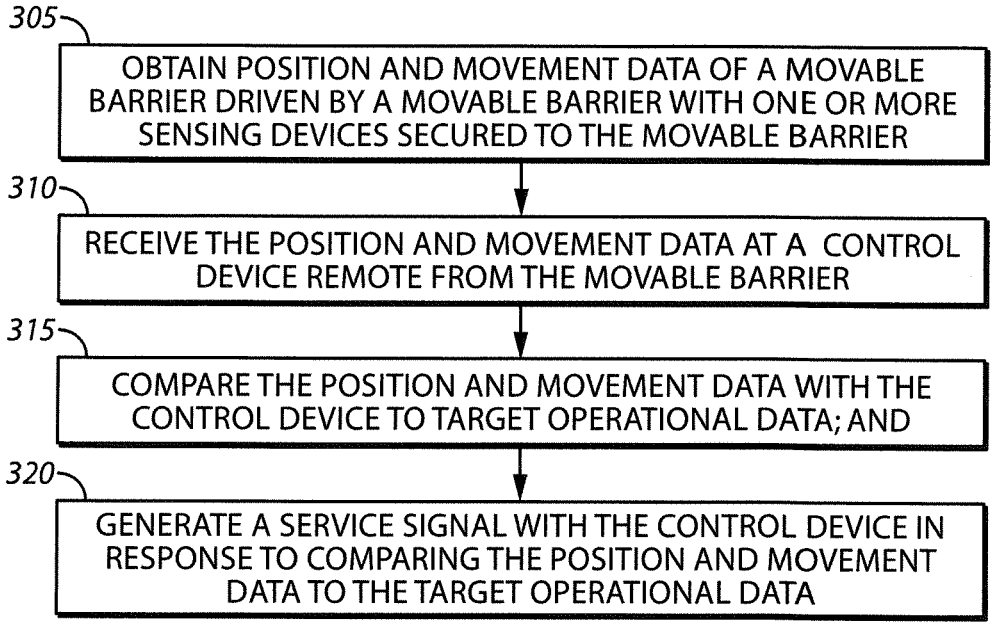
FIG. 8 is a flow diagram of an example method of operation for a barrier sensor device as configured in accordance with various embodiments of the invention.

Analysis of the data collected by the barrier sensor device 10 will now be discussed with respect to FIG. 8 showing one example method 300. Generally, in a first step 305, the barrier sensor device 10 obtains and sends the position and movement data to the control device 30. The control device 30 is configured to receive 310 the position and movement data collected by the sensing devices 21 and compare 315 the position and movement data to target operational data. If the position and movement data indicates that the barrier operator system 12 is under unnecessary or critical strain, the control device 30 can be configured to generate 320 and send a service signal to a recipient, such as one of the network devices discussed above, which can correspond to an owner or service entity.

In one specific example, the control device, or a server device in communication with the control device 10, can utilize a barrier open time $t_o$, the time to move the barrier 16 from a closed position to an open position, and a barrier close time $t_c$, the time to move the barrier 16 from an open position to a closed position, to monitor whether the barrier operator 14 is experiencing strain, whether from a mechanical issue with the operator itself, the guiderails, or the counter-balance mechanism.

More specifically, in one approach, the control device utilizes a ratio of the barrier open time over the barrier close time. Because a properly balanced door and ideal guidance structure provides a barrier with smooth and consistent operation, an acceptable range or value for the ratio can be determined. Once a baseline acceptable range or value is established, subsequent measured values exceeding the acceptable value is a result of added operation time created by gravity and friction in some manner. Accordingly, a specific barrier's ratio values over time can provide a trend line that can track a prediction to failure. If desired, the control device can consider a set of factors for each operation when building a moving average of a barrier system or a norm for a plurality of barrier systems to revise or classify the collected data. These factors can include one or more of: door metrics (such as width, height, material, etc.), weather, number of total operations, and the like. For example, the data can be adjusted or annotated to allow higher strain for relatively larger barriers, such as a higher strain for two car doors v. one car doors. In another example, the control device 30 can access or receive local weather conditions to adjust or annotate data to allow for higher strain for windy or humid conditions. In yet another example, the data can be adjusted or annotated to allow for higher strain along with the increasing number or operations performed by a barrier operator.

In an ideal environment movable barrier environment, the ratio of $t_o/t_c$ would be 1. Any amount over 1, therefore, can be viewed as an increment of the optimal efficiency of operation and can be expressed as 1+Y. In this equation, Y is a stress value accounting for the extra time introduced by gravity and friction in excess of normal operation.

In one example, a "normal" barrier operator system, including a barrier operator, barrier, guiderails, and counter-balance mechanism, installed according to the instructions in a garage-type environment was compared to a similarly-installed "strained" barrier operator system strained with 10 lbs. of extra weight, which simulates any of the strains on such a system. The test ran the normal system through 10 cycles of opening and closing. While the range of specific operations was inconsistent, 1.0021755-1.0321873, averaging the ratio values of these 10 cycles provided a normal or target operation average of 1.016, with an average of the Y values, Z, being 0.016. The test then ran the strained system through 7 cycles of opening and closing, the value being less than 10 because the barrier operator overheated. The range of 1.0159305-1.0634328 for the strained system provided a strained average of 1.032, with a Z value of 0.032. Accordingly, the strained door had a Z value about two times the Z value of the normal door. The control device 30, for example, can be configured to generate and send the service signal in response to determining that a measured Y value exceeds the target operation data by 2 or more times.

Due to the inconsistencies in the ratio from operation to operation, a barrier system can more accurately be analyzed when a rolling average thereof is viewed over a series of operations, such as 5, 10, 20, or other number of previous operations. Moreover, by segmenting increased values of Z, the control device 30 can track the increased values over time.

In the above example, a threshold of 70% over the normal Z value was determined to provide an indication of strained when viewed over a series of operations. More specifically, deviations of each operation from the rolling average can be calculated and compared to the target operation data.

By one approach, the target operation data is the Z value of the rolling average. In the above example, only one of the ten "normal" operations produced a Y value more than 70% of the "normal" Z value. In comparison, five of the seven "strained" operations produced a Y value more than 70% of the "normal" Z value. While 70% was utilized in this example, other values can also be utilized to compare newly obtained data to "normal" or benchmark data. Further, the threshold can be fine-tuned by analyzing a plurality of door operators' data. Thus, the control device 30 can be configured to generate and send the service signal in response to determining that a preset number, such as 20%, 30%, 40%, 50%, 60%, 70%, 80%, 90%, or 100%, of the measured operations exceed the threshold.

The data can be analyzed in a number of ways. In a first example, the control device 30 can simply compare measured Y values to the rolling average Z. Upon a preset number of Y values within a range being greater than a threshold percentage of Z, the control device 30 can generate the service signal and transmit the signal to one of the peripheral devices with which it is in communication, such as the mobile device 215.

A second approach utilizes a first-in, first-out (FIFO) data evaluation process so that the barrier system, and the Y value thereof, can be viewed over the most recent series of operations, such as the previous 5, 10, 20, or more operations. This approach can also be utilized when data storage is limited. Moreover, benchmark or normal operation values can also be stored, and the FIFO values can be compared against these benchmark values. This provides added protection because a rolling average can increase slightly over time and eventually reach a breaking point. Alternatively, an acceptable range or value for Y can be provided to the control device 30 and the barrier values compared with this acceptable range or value. For example, a database of data can be compiled from a plurality of barrier operator systems to determine the acceptable range or value.

A third approach includes providing a "diagnostic mode" functionality for the barrier sensor device 10 and the control device 30. This diagnostic mode would allow a dealer or consumer to put the barrier sensor device 10 into the "diagnostic mode" and run a series of open and close commands, such as 5, 10, 20, or the like, and have the control device 30 analyze the data to compare to a database of acceptable performance. As such, the control device would not have to store operational data. Instead, the analysis would be triggered on command from time to time.

In addition, an absolute value for Y can be provided to the control device 30. The Y absolute value would correspond to a value where it is clear that barrier operation is outside of any recommended tolerance. For example, a user can adjust barrier force to compensate for a poor operating door. In order to avoid this scenario, the barrier sensor device 10 can include a "door operation verification process" mode that is configured to operate upon installation. This mode can include running a series of opening and closing operations and collecting measurements therefrom. These measurements can then be compared to the Y absolute value by the control device 30 to ensure that the barrier system is operating in an acceptable tolerance range before completing installation.

Those skilled in the art will recognize that a wide variety of modifications, alterations, and combinations can be made with respect to the above described embodiments without departing from the scope of the invention. For example, although the barrier sensor device and control device are described largely in the context of a garage in use with a garage door opener, such devices can be applied in other barrier operator contexts, such as gate operators and the like. Moreover, the retro-fit features described herein can be incorporated into a movable barrier operator. Such modifications, alterations, and combinations are to be viewed as being within the ambit of the inventive concept.

What is claimed is:

1. A retrofit monitoring apparatus for a movable barrier system, the apparatus comprising:

one or more sensing devices configured to be secured to a movable barrier driven by a movable barrier operator and to obtain position and movement data of the movable barrier, the position and movement data comprising data regarding a movable barrier operation comprising an open time and a close time, the sensing devices being configured to determine the open time for the movable barrier to travel from a closed position to an open position and determine the close time for the movable barrier to travel from an open position to a closed position, wherein the sensing devices determine the open time and the close time without communication with the movable barrier operator;

a control device remote from the movable barrier operator and configured to be in communication with the sensing devices, the control device configured to:

receive the position and movement data;

calculate a ratio of the open time to the close time;

determine a stress value from the ratio;

compare the stress value to target operational data; and selectively generate a service signal in response to comparing the stress value to the target operational data.

2. The apparatus of claim 1 wherein the control device is further configured to generate the service signal to indicate a potential problem with the status of at least one of: a movable barrier operator; a counter-balance mechanism; or movable barrier guidance structure.

3. The apparatus of claim 1 wherein the sensing devices comprise a tilt switch and accelerometer configured to determine position and movement of the movable barrier.

4. The apparatus of claim 1 wherein the control device is configured to send the service signal in response to the stress value exceeding the target operational data by a factor of 2 or more.

5. The apparatus of claim 1 wherein the control device is further configured to account for factors affecting the movable barrier operation in determining the stress value, the factors comprising one or more of friction, gravity, movable barrier size, weather, temperature, or a number of previous operations.

6. The apparatus of claim 1 wherein the target operational data comprises an acceptable range for the stress value; and the control device is configured to:

receive data regarding a series of movable barrier operations;

compare stress values from the data of the series of movable barrier operations to the acceptable range for the stress value; and generate the service signal in response to determining that a preset number of the stress values exceed the acceptable range.

7. The apparatus of claim 1 wherein the control device is configured to:

receive data regarding a series of movable barrier operations;

calculate a rolling average of the stress values of the data of the series of movable barrier operations;

calculate deviations of the stress values from the rolling average; and compare the deviations of the stress values to the target operational data.

8. The apparatus of claim 7 wherein the target operational data comprises the rolling average; and the control device is configured to generate the service signal in response to determining that a preset number of the deviations of the stress values exceed a preset percentage over the rolling average.

9. The apparatus of claim 7 wherein the target operational data comprises a benchmark rolling average of stress values compiled after installation or reset of the movable barrier operator.

10. The apparatus of claim 9 wherein the control device is configured to:

utilize a first in, first out (FIFO) process to sequentially update the rolling average of the stress values to create updated deviations of the stress values from the rolling average; and compare the updated deviations to the benchmark rolling average.

11. The apparatus of claim 1 further comprising a processing device operably coupled to the sensing devices; and wherein the sensing devices and the control device are remote from one another; and the sensing devices are configured to obtain and the processing device is configured to cause the position and movement data to be transmitted according to one or more parameters, the parameters being configurable by a configuration signal sent to the processing device from the control device.

12. The apparatus of claim 11 wherein the control device is configured to transmit the configuration signal in response to reception of a signal from the processing device.

13. The apparatus of claim 11 wherein the sensing devices are configured to operate in a sleep mode subject to a timer on the processing device, the processing device configured to obtain and transmit the position and movement data in response to expiration of the timer.

14. A retrofit monitoring apparatus for a movable barrier system, the apparatus comprising:

a housing configured to be secured to a movable barrier driven by a movable barrier operator;

one or more sensing devices disposed within the housing and configured to obtain position and movement data of the movable barrier, the position and movement data comprising data regarding a movable barrier operation comprising an open time and a close time; and wherein the sensing devices are configured to be in communication with a control device remote from the movable barrier operator, the control device configured to:

receive the position and movement data;

calculate a ratio of the open time to the close time;

determine a stress value from the ratio;

compare the stress value to target operational data; and selectively generate a service signal in response to comparing the stress value to the target operational data.

15. The apparatus of claim 14 wherein the control device is disposed within the housing.

16. The apparatus of claim 14 further comprising a processing device disposed within the housing and operably coupled to the sensing devices; and wherein the sensing devices and the control device are remote from one another; and the sensing devices are configured to obtain and the processing device is configured to cause the position and movement data to be transmitted to the control device according to one or more parameters, the parameters being configurable by a configuration signal sent to the processing device from the control device.

17. The apparatus of claim 16 wherein the control device is configured to transmit the configuration signal in response to reception of a signal from the processing device.

18. The apparatus of claim 16 wherein the sensing devices are configured to operate in a sleep mode subject to a timer on the processing device, the processing device configured to obtain and transmit the position and movement data in response to expiration of the timer.

19. The apparatus of claim 14 wherein the control device is further configured to generate the service signal to indicate a potential problem with the status of at least one of: a movable barrier operator; a counter-balance mechanism;

or movable barrier guidance structure.

20. The apparatus of claim 14 wherein the sensing devices comprise a tilt sensor configured to determine position of the movable barrier and an accelerometer sensor configured to determine movement of the movable barrier.

21. The apparatus of claim 18, the sensing devices being configured to:

determine the open time for the movable barrier to travel from a closed position to an open position by monitoring a status of the tilt sensor and how long the accelerometer sensor senses movement; and determine the close time for the movable barrier to travel from an open position to a closed position by monitoring a status of the tilt sensor and how long the accelerometer sensor senses movement;

wherein the sensing devices determine the open time and the close time without communication with the movable barrier operator.

22. The apparatus of claim 14 wherein the control device is configured to generate the service signal in response to the stress value exceeding the target operational data by a factor of 2 or more.

23. The apparatus of claim 14 wherein the control device is further configured to account for factors affecting the movable barrier operation in determining the stress value, the factors comprising one or more of movable barrier size, weather, temperature, or a number of previous operations.

24. The apparatus of claim 14 wherein the target operational data comprises an acceptable range for the stress value; and the control device is configured to:

receive data regarding a series of movable barrier operations;

compare stress values from the data of the series of movable barrier operations to the acceptable range for the stress value; and generate the service signal in response to determining that a preset number of the stress values exceed the acceptable range.

25. The apparatus of claim 14 wherein the control device is configured to:

receive data regarding a series of movable barrier operations;

calculate a rolling average of the stress values of the data of the series of movable barrier operations;

calculate deviations of the stress values from the rolling average; and compare the deviations of the stress values to the target operational data.

26. The apparatus of claim 25 wherein the target operational data comprises the rolling average; and the control device is configured to generate the service signal in response to determining that a preset number of the deviations of the stress values exceed a preset percentage over the rolling average.

27. The apparatus of claim 25 wherein the target operational data comprises a benchmark rolling average of stress values compiled after installation or reset of the movable barrier operator.

28. The apparatus of claim 27 wherein the control device is configured to:

utilize a first in, first out (FIFO) process to sequentially update the rolling average of the stress values to create updated deviations of the stress values from the rolling average; and compare the updated deviations to the benchmark rolling average.

29. A method comprising:

obtaining position and movement data of a movable barrier driven by a movable barrier with one or more sensing devices secured to the movable barrier, the position and movement data comprising data regarding a movable barrier operation comprising an open time and a close time;

receiving the position and movement data at a control device remote from the movable barrier operator;

calculating, with the control device, a ratio of the open time to the close time;

determining, with the control device, a stress value from the ratio; and comparing the stress value with the control device to target operational data; and selectively generating a service signal with the control device in response to comparing the position and movement data to the target operational data.

30. The method of claim 29 wherein generating the service signal comprises generating a service signal to indicate a potential problem with the status of at least one of: a movable barrier operator; a counter-balance mechanism; or movable barrier guidance structure.

31. The method of claim 29 wherein obtaining the position and movement data comprises obtaining position and movement data with a tilt switch and accelerometer.

32. The method of any of claim 31 wherein obtaining the position and movement data comprises obtaining, with the sensing device, data regarding the movable barrier operation comprising the open time and the close time without communication with the movable barrier operator, the obtaining the data regarding the movable barrier operation comprising:

determining the open time for the movable barrier to travel from a closed position to an open position by monitoring a status of the tilt sensor and how long the accelerometer sensor senses movement; and determining the close time for the movable barrier to travel from an open position to a closed position by monitoring a status of the tilt sensor and how long the accelerometer sensor senses movement.

33. The method of claim 29 wherein generating the service signal comprises generating a service signal in response to the stress value exceeding the target operational data by a factor of 2 or more.

34. The method of claim 29 further comprising accounting for factors affecting the movable barrier operation in determining the stress value with the control device, the factors comprising one or more of movable barrier size, weather, temperature, or a number of previous operations.

35. The method of claim 29 wherein:

receiving the position and movement data comprises receiving data regarding a series of movable barrier operations; and further comprising:

comparing the position and movement data to the target operational data comprises comparing stress values from the data of the series of movable barrier operations to an acceptable range for the stress value; and generating the service signal comprises generating a service signal in response to determining that a preset number of the stress values exceed the acceptable range.

36. The method of claim 29 wherein receiving the position and movement data comprises receiving data regarding a series of movable barrier operations; and further comprising: calculating a rolling average of the stress values of the data of the series of movable barrier operations; and calculating deviations of the stress values from the rolling average; and wherein comparing the position and movement data to the target operational data comprises comparing the deviations of the stress values to the target operational data.

37. The method of claim 36 wherein the target operational data comprises the rolling average; and generating the service signal comprises generating a service signal in response to determining that a preset number of the deviations of the stress values exceed a preset percentage over the rolling average.

38. The method of claim 36 wherein comparing the deviations of the stress values to the target operational data comprises comparing the deviations of the stress values to a benchmark rolling average of stress values compiled after installation or reset of the movable barrier operator.

39. The method of claim 38 further comprising utilizing a first in, first out (FIFO) process, with the control device, to sequentially update the rolling average of the stress values to create updated deviations of the stress values from the rolling average; and wherein comparing the deviations of the stress values to the benchmark rolling average comprises comparing the updated deviations of the stress values to the benchmark rolling average.

40. The method of claim 29 wherein the sensing devices and the control device are remote from one another; and further comprising transmitting the position and movement data, with a processing device operably coupled to the sensing devices, to the control device according to one or more parameters, the parameters being configurable by a configuration signal sent to the processing device from the control device.

41. The method of claim 40 further comprising transmitting the configuration signal at the direction of the control device in response to reception of a signal at the control device from the processing device.

42. The method of claim 40 further comprising the sensing devices operating in a sleep mode subject to a timer on the processing device, and wherein transmitting the position and movement data comprises transmitting the position and movement data, with the processing device, in response to expiration of the timer.

* * * * *